United States Patent [19]

Rubinstein et al.

[11] Patent Number: 4,673,306

[45] Date of Patent: Jun. 16, 1987

[54] MAGNETIC PAPER CLAMP

[75] Inventors: Stanley Rubinstein, Sepulveda; Stephen B. Baker, Saugus, both of Calif.

[73] Assignee: Dataproducts Corporation, Woodland Hills, Calif.

[21] Appl. No.: 629,961

[22] Filed: Jul. 11, 1984

[51] Int. Cl.[4] ..... B41J 15/16

[52] U.S. Cl. ..... 400/618; 101/382 MV; 400/616.1; 400/656

[58] Field of Search ..... 400/618, 616.1, 656; 226/195; 101/382 MV; 16/320, DIG. 1 V

[56] References Cited

U.S. PATENT DOCUMENTS

| | | | |
|---|---|---|---|
| 2,110,855 | 3/1938 | Fyfe et al. | 400/618 X |
| 2,111,116 | 3/1938 | Holzappfel | 400/618 X |
| 3,307,672 | 3/1967 | Young | 400/29 |
| 3,323,700 | 6/1967 | Epstein et al. | 400/618 X |
| 3,421,612 | 1/1969 | Pitt | 400/584 |
| 3,802,546 | 4/1974 | Helms | 400/618 |
| 4,167,346 | 9/1979 | Holland-Letz | 400/618 |
| 4,444,522 | 4/1984 | Suzuki et al. | 400/618 X |

FOREIGN PATENT DOCUMENTS

| | | | |
|---|---|---|---|
| 2637402 | 2/1978 | Fed. Rep. of Germany | 400/618 |
| 2363443 | 5/1978 | France | 400/618 |
| 55-91688 | 7/1980 | Japan | 400/618 |
| 57-191080 | 11/1982 | Japan | 400/618 |

OTHER PUBLICATIONS

"Paper Clamp with Electromagnet etc." by Abendschein et al, *IBM Technical Disclosure Bulletin,* vol. 25, No. 2, Jul. 1982.

"Magnetic Paper-Gripping Concept" by Palmer, *Xerox Disclosure Journal,* p. 107, vol. 3, No. 2, Mar./Apr. 1978.

*Primary Examiner*—Edgar S. Burr
*Assistant Examiner*—Moshe I. Cohen
*Attorney, Agent, or Firm*—Spensley Horn Jubas & Lubitz

[57] ABSTRACT

A paper clamp is provided for a computer printer in which the paper is continuously clamped while the paper is advanced and printed. In one embodiment, a clamp magnet is positioned on one side of the paper path opposite a clamp plate on the other side of the paper path. The paper is clamped by the magnetic attraction between the clamp magnet and clamp plate.

5 Claims, 5 Drawing Figures

MAGNETIC PAPER CLAMP

BACKGROUND OF THE INVENTION

1. Field of Invention

The present invention relates to computer printers, and more particularly, to computer printers having devices for clamping the paper as the paper is printed.

2. Description of the Prior Art

In one type of computer printer, the type faces of the characters to be printed are carried on a medium such as a character band or character drum which rapidly moves past a printing station. The printing station typically includes one or more banks of aligned, individually actuable hammers. Disposed between the hammers and the moving character medium is a ribbon and the paper to be printed. Printing is accomplished by actuating each hammer at the appropriate time to propel it against the moving surface of the character medium when the character to be printed moves into alignment with the hammer striking face.

The paper is normally stepped one line at a time to the print station with a full line being printed between successive paper movements. One type of advancement mechanism for stepping the paper is known as a tractor feed which includes a pair of continuous loop belts disposed at the edges of the paper path. Each belt has outwardly extending teeth which engage holes provided at the edges of the paper. As the belts circulate, the paper is drawn forward. One such tractor feed is usually located past or "downstream" of the printing station. Optionally, a second tractor feed may be positioned "upstream" of the printing station and is operated in unison with the downstream tractor feed.

One problem associated with moving character media is that the character medium tends to pull the paper as the hammer strikes the paper against the moving medium, unless the paper is secured as each line is printed. Such movement of the paper can misalign the printing with a corresponding loss in printing quality.

Moreover, the paper often becomes particularly unstable when the end of the paper roll (or continuous folded paper) passes the upstream tractor feed. This instability can significantly disrupt the printing so that the last sheet must be reprinted. Consequently, time is often spent in resetting the starting point of the computer data for the next sheet coming up for printing. In addition, it is possible to lose the misprinted data in some circumstances.

In order to prevent the character band from moving the paper, devices such as spring-loaded clamps have been utilized to clamp the paper as each line is printed. However, because the clamping force typically provided by such clamps often will not allow the paper to be advanced while the clamp is activated, means are usually provided to lift the clamp from the paper after each line has been printed in order to advance the paper another line. After the paper has been advanced to the next line, the clamp is again lowered to the paper to secure the paper for the next printing operation.

Electromagnets have typically been used to lift and lower the spring-loaded clamps for each advance and print step. Such arrangements have tended to be relatively complicated, expensive to manufacture and subject to breakdown.

SUMMARY OF INVENTION

It is an object of the present invention to provide a paper clamp obviating for practical purposes, the above mentioned limitations.

It is another object of the present invention to provide a paper clamp for a printer which is relatively inexpensive, simple in construction and high in reliability and effectiveness.

It is still another object of the present invention to provide a paper clamp which squeezes the air out from between the sheets of multi-part paper to improve the quality of the printing of such paper.

These and other objects and advantages are achieved in a printer paper clamp which applies a relatively constant and continuous clamping force to the paper while the paper is being both advanced and printed. In one embodiment, the paper clamp includes a plate of ferromagnetic material which is disposed on one side of the paper path. A permanent magnet is disposed on the other side of the paper path and is positioned opposite the plate so that the magnetic attraction of the magnet for the plate continuously clamps the paper between the magnet and the plate. Such an arrangement holds the paper against lateral movement, particularly when the end of the paper has already passed the upstream advancement mechanism.

In another aspect of the present invention, the paper clamp further includes a spacer element of nonferromagnetic material which is disposed between the magnet and the plate. The spacer element has a predetermined thickness to control the magnetic attraction and hence the clamping force between the magnet and plate. In this manner, tearing of the paper by the paper clamp while the paper is being advanced can be minimized or eliminated.

DETAILED DESCRIPTION OF THE DRAWINGS

Figures 1, 2:
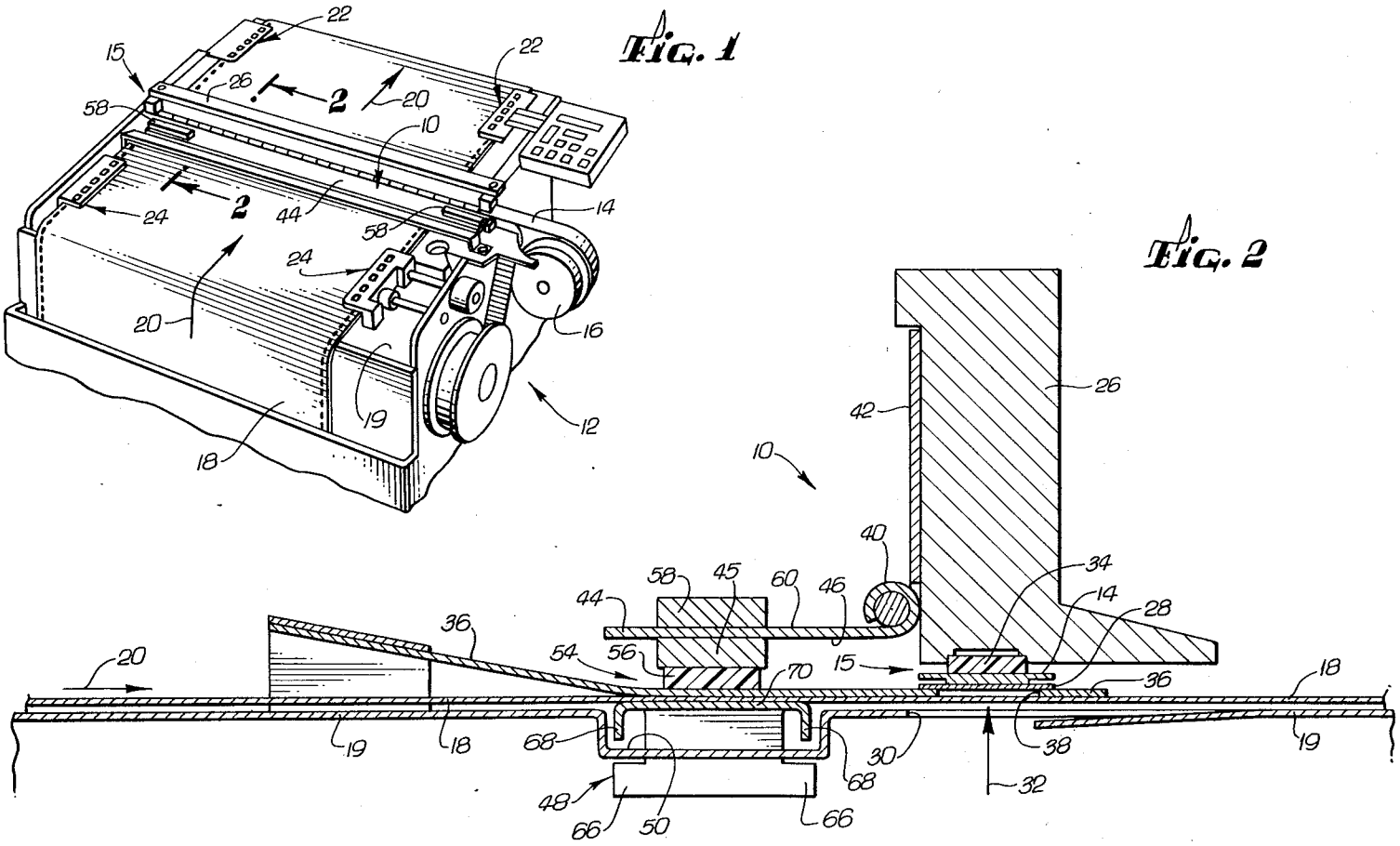
FIG. 1 is a fragmentary pictorial view of a printer employing a paper clamp in accordance with a preferred embodiment of the present invention.
FIG. 2 is a partial cross-sectional view along the lines 2—2 of the paper clamp of FIG. 1.

Referring now to FIG. 1, a paper clamp in accordance with a preferred embodiment of the present invention is indicated generally at 10. The paper clamp 10 is shown installed on a computer printer 12 which has a moving character band 14. Character type faces are embossed on the character band 14 which is moved continuously through a print station 15 by a pair of pulleys, one of which is indicated at 16.

Paper 18 is guided by the printer 12 to follow a paper path as indicated by the arrows 20. A tractor feed 22 is positioned downstream of the character band 14 to advance the paper forward one line at a time to the print station 15. A second tractor feed 24 is positioned upstream of the character band 14 and operates in unison with the downstream tractor feed 22 to advance the paper. The paper 18 is generally supported by a cover 19 enclosing the hammer banks of the print station 15 as the paper passes through the print station 15.

Mounted over the hammer bank cover 19 is a platen 26 which extends transversely across the paper path 20. As best seen in FIG. 2, the platen 26 is positioned directly over the character band 14. Positioned directly below the character band 14 is a ribbon 28.

As shown in FIG. 2, the path 20 of the paper 18 passes between the ribbon 28 and the hammer bank cover 19. The hammer bank cover 19 has an opening 30 at the print station 15 through which the tips of the hammers of the hammer banks pass in the direction indicated by the arrow 32.

As previously mentioned, the character band 14 is rapidly moved across the print station, sequentially moving each character of the character band across each character print position of the print station. When the character type face of a character desired to be printed moves into position at the desired character position, the associated print hammer is actuated. The hammer tip of the activated hammer passes through the hammer bank assembly cover opening 30 striking the paper 18, driving the paper 18 against the ribbon 28 and character band 14 and causing a character to be printed on the paper 18. The platen 26 has a plastic print strip of vespel 34 which provides a printing surface against which the hammer tips drive the paper, ribbon 28 and character band 14. A stainless steel ribbon shield 36 positioned between the paper 18 and ribbon 28 protects the paper 18 from smudging by the ribbon 28. The ribbon shield 36 has an opening 38 through which the paper 18 is driven against the ribbon 28 and character band 14.

Because the character band 14 is moving, the character band has a tendency to pull the paper laterally when the hammer tips drive the paper against the ribbon and character band 14. This tendency is counteracted by the tractor feeds 22 and 24 (FIG. 1) which hold the paper in place as each line is being printed. However, when the end of the paper 18 passes the upstream tractor feed 24, the end of the paper is no longer secured. This can allow the moving character band to displace the paper resulting in misalignment of the printing at the bottom of the page as described above. In order to prevent such misalignment from occurring, the paper clamp 10 in accordance with the present invention continuously clamps the paper 18 so that when the end of the paper passes the upstream tractor feed 24, the paper 18 is held against movement by the character band 14.

As shown in FIGS. 1 and 2, the paper clamp 10 includes a piano-type hinge 40 which includes a first leaf 42 mounted vertically to the platen 26. The hinge 40 extends the full length of the platen 26 with the pivot axis of the hinge 40 being positioned parallel to the plane of the paper path and transverse to the direction of paper travel.

Figure 4:
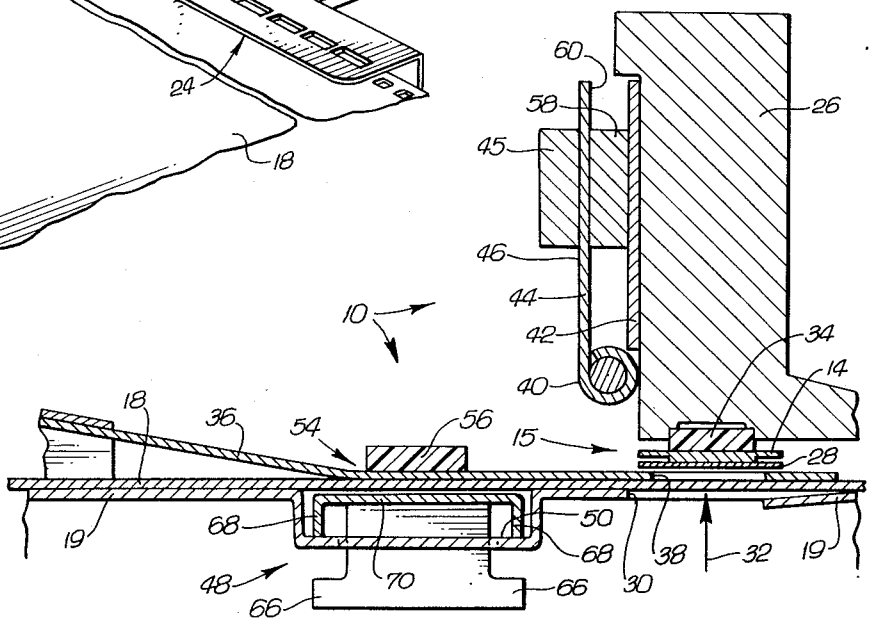
FIG. 4 is a cross-sectional view of the paper clamp of FIG. 3.
Figure 3:
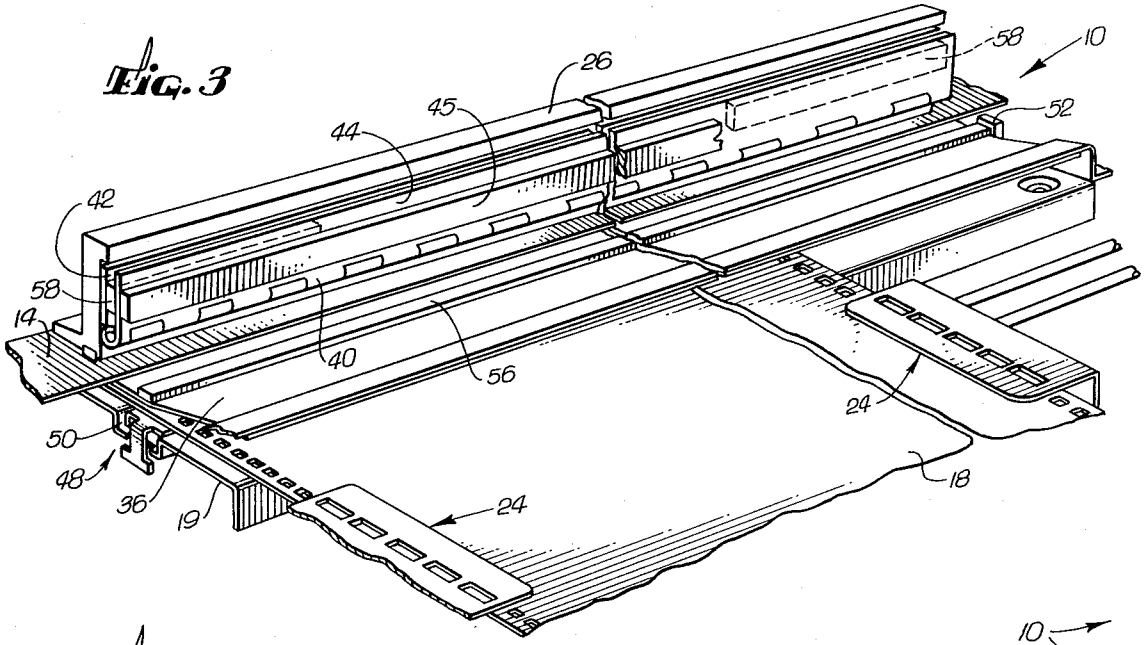
FIG. 3 is a fragmentary pictorial view of the paper clamp of FIG. 3 shown in the stowed position.

A second leaf 44 of the hinge 40 is free to pivot between a "clamp" position shown in FIGS. 1 and 2 and a "stowed" position shown in FIGS. 3 and 4. Depending from the outward side 46 of the free leaf 44 is a strip magnet 45 which in the illustrated embodiment extends substantially the full length of the free leaf 44.

The paper clamp 10 further includes a clamp plate 48 loosely carried in a depression 50 defined by the hammer bank cover 19. The clamp plate 48 has a narrow, rectangular upper surface 70 (FIGS. 2, 4 and 5) which is approximately the same length as but is somewhat wider than the clamp magnet 45. The clamp magnet 45 is mounted on the free leaf 44 so that it is positioned opposite the clamp plate 48 when the hinge leaf 44 is in the clamp position of FIG. 2. In this position, the free leaf 44 of the hinge 40 rests on projecting stop members (indicated at 52 in FIG. 3) located on either side of the paper path. The stop members 52 limit the downward movement of the free hinge leaf 44.

Because the clamp plate 48 is made of a ferromagnetic material such as stainless steel, the magnetic attraction provided by the clamp magnet 45 pulls the clamp plate 48 up out of the hammer bank cover depression 50 and towards the clamp magnet 45, clamping the paper 18 therebetween. In order to control the magnetic attraction of the clamp magnet 45 for the clamp plate 48, a spacer 54 of non-ferromagnetic material is provided between the clamp magnet 45 and the clamp plate 48. In the illustrated embodiment, the spacer 54 includes the portion of the stainless steel ribbon shield 36 which is between the clamp magnet 45 and clamp plate 48, and a polyester spacer strip 56 mounted on the ribbon shield 36 The combined thicknesses of the ribbon shield 36 and spacer strip 56 of approximately 0.034 inches in the illustrated embodiment reduces the attraction of the clamp magnet 45 for the clamp plate 48 so that the paper 18 is not torn by the tractor feeds 22 and 24 when the paper 18 is advanced through the clamp 10. At the same time, the clamping force applied to the paper 18 by the clamp magnet 45 and clamp plate 48 is sufficient to securely hold the paper 18 against lateral movement when the end of the paper has passed the upstream tractor feed 24. The clamp magnet 45 shown is a ceramic magnet and is approximately $\frac{3}{8}$ inches wide and 3/32 inches thick. Of course magnets and spacers of other compositions and dimensions may be used depending upon the particular application.

Because the clamp 10 operates continuously, the paper clamp 10 does not utilize expensive and complicated electromagnetic actuators to disengage the clamp while the paper is advanced. In addition, the continuously operating clamp acts to squeeze air pockets from between the sheets of multipart paper as the paper passes between the clamp magnet 45 and clamp plate 48. Consequently, the printing quality of such multipart paper is improved.

As previously mentioned, the free leaf 44 is supported by the stop members 52 so that the clamp magnet 45 is suspended over the clamp plate 48. The clamp plate 48 attracted by the clamp magnet 45, lifts the paper 18 (and ribbon shield 36) off the hammer bank cover 19 and closer to the ribbon 28 and character band 14. As a result, the tips of the hammers move the surface of the paper a shorter distance to reach the ribbon 28 and character band 14. Removal of this slack from the paper 18 further improves the quality of the printing operation.

In order to disengage the clamp 10 to change the paper or add additional paper after the initial supply is exhausted, the free hinge leaf 44 is merely pivoted upward away from the clamp plate 48. The free hinge leaf 44 has a pair of stow magnets 58 (FIG. 1) mounted on the inner side 60 of the leaf 44 which latches the free leaf 44 to the mounting leaf 42 in the stowed position as shown in FIGS. 3 and 4.

Figure 5:
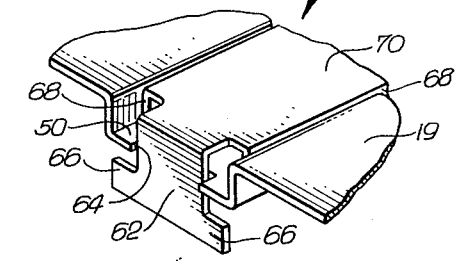
FIG. 5 is a fragmentary pictorial view of the end of the plate of the paper clamp of FIG. 1.

Referring now to FIG. 5, the clamp plate 48 has an end tab 62 at each end, which extends through a slot 64 in the depression 50 of the hammer bank cover 19. Extending laterally from either side of the tab 62 is a pair of ears 66 which engage the bottom surface of the hammer bank cover depression 50 to prevent the cover plate 48 from being pulled completely out of the depression 50 when the free hinge leaf 44 is pivoted upward into the stowed position. Once released from the magnetic attraction of the clamp magnet 45, the clamp plate 48 falls back into the hammer bank cover depression 50. The clamp plate 48 has rounded, downwardly extending flange members 68 (FIG. 4) which limit the downward movement of the clamp plate 48. The flange members 68 extend sufficiently downward so that the upper surface 70 of the clamp plate 48 is flush with the surface of the hammer bank cover 19 adjacent the depression 50.

It is seen from the above that a paper clamp in accordance with the present invention provides a simple yet effective mechanism for securely holding the paper, particularly where the end of the paper has passed an upstream advancement mechanism. It will, of course, be understood that modifications of the present invention, in its various aspects, will be apparent to those skilled in the art, some being apparent only after study and others being merely matters of routine mechanical design. Other embodiments are also possible, with their specific designs dependent upon the particular application. For example, it is recognized that a paper clamp in accordance with the present invention may be utilized on other types of computer printers other than the character band printer with tractor feeds illustrated. In addition, other configurations of magnets and clamping plates may be utilized. As such, the scope of the invention should not be limited by the particular embodiment herein described, but should be defined only by the appended claims and equivalents thereof.

We claim:

1. A paper clamp for clamping paper in a printer having a paper path defining the path of travel of the paper and a ribbon shield disposed adjacent the paper path, said clamp comprising:

a strip-shaped clamp plate made of ferromagnetic material and disposed on one side of the paper path and transverse to the direction of travel of the paper;

means for mounting the clamp plate to the printer to prevent substantial movement of the clamp plate in the direction of paper travel;

a longitudinal mounting member pivotally coupled to the printer on the other side of the paper path, said member having a pivot axis parallel to the clamp plate;

a strip-shaped spacer strip carried by the ribbon shield parallel to and disposed over the clamp plate;

a strip-shaped clamp magnet depending from one side of the mounting member, said mounting member being movable to a "clamp" position so as to position the clamp magnet adjacent the spacer strip and opposite the clamp plate to attract the clamp plate and clamp the paper, ribbon shield and spacer strip between the clamp magnet and the clamp plate as the paper travels through the paper clamp;

a stow magnet carried on the other side of the mounting member, said mounting member being movable to a "stowed" position so as to position the stow magnet adjacent the a portion of the printer away from the paper path to releasably fasten the mounting member to the printer portion and to stow the clamp magnet away from the paper path.

2. A paper clamp for clamping paper in a printer having a paper path defining the path of travel of the paper, and advance means for advancing the paper to a print station at which the paper is printed, said clamp comprising:

a plate of ferromagnetic material disposed on one side of the paper path;

a permanent magnet disposed on the other side of the paper path;

means for positioning the magnet opposite the plate while the paper is being advanced and printed so that the magnetic attraction of the manget for the plate continuously clamps the paper between the magnet and the plate while the paper is being advanced and printed;

means for controlling the magnetic attraction and the clamping force between the magnet and plate as the paper advances to the printer, said means including a spacer element of non-ferromagnetic material disposed between the magnet and the plate and having a predetermined thickness to control the spacing between the magnet and plate; and means for restricting the movement of the magnet and the plate in the direction of paper advancement so that as the paper advances to the printer, the paper advances through the paper clamp while the plate clamps the paper between the magnet and the plate.

3. The clamp of claim 2 wherein the positioning means further comprises a stow magnet for securing the clamp magnet away from the clamp plate in a "stowed" position.

4. The clamp of claim 2 wherein the restricting means has means for loosely mounting the clamp plate on the printer and has members for limiting the movement of the plate.

5. The clamp of claim 2 wherein the printer includes a platen on which the paper is printed, said positioning means including means for positioning the magnet so that the clamp plate under the attraction of the magnet, positions the paper in physical proximity to the platen.

* * * * *